United States Patent [19]

Jacobs

[11] 4,037,382

[45] July 26, 1977

[54] SCAFFOLDING

[75] Inventor: Daniel Jacobs, Johannesburg, South Africa

[73] Assignee: Form-Scaff (Proprietary) Limited, Johannesburg, South Africa

[21] Appl. No.: 679,248

[22] Filed: Apr. 22, 1976

[30] Foreign Application Priority Data

Apr. 24, 1975 South Africa ..... 75/2650

[51] Int. Cl.[2] ..... E04H 12/10; E04G 1/06

[52] U.S. Cl. ..... 52/638; 182/179; 403/49; 403/353

[58] Field of Search ..... 52/638, 637; 182/179, 182/178; 403/217, 49, 353

[56] References Cited

U.S. PATENT DOCUMENTS

| | | | |
|---|---|---|---|
| 1,553,800 | 9/1925 | Brandt | 402/217 |
| 3,156,329 | 11/1964 | Alberti | 52/638 |
| 3,245,188 | 4/1966 | Evans | 182/178 |
| 3,490,189 | 1/1970 | Gostling | 182/178 |

FOREIGN PATENT DOCUMENTS

| | | |
|---|---|---|
| 2,217,431 | 7/1974 | Germany |

*Primary Examiner*—James L. Ridgill, Jr.
*Attorney, Agent, or Firm*—Murray and Whisenhunt

[57] ABSTRACT

A scaffolding element comprises a triangular frame having a vertical member, a horizontal member and a diagonal member and further having a yoke at the free ends of the horizontal and diagonal members. This yoke has an upper arm with an aperture therein to receive the upper end of the vertical member of an adjacent frame and a lower arm. This lower arm has a slot into which the vertical member is received below the horizontal member.

9 Claims, 3 Drawing Figures

SCAFFOLDING

This invention relates to scaffolding.

The invention is concerned with a scaffolding element of the kind comprising a right angled triangular frame consisting of a vertical member, a horizontal member extending from near the upper end of the vertical member, an inclined member extending upwardly from near the lower end of the vertical member, and an end element at the ends of the horizontal and inclined members remote from the vertical member.

According to one aspect of this invention, there is provided a scaffolding element of the kind set forth wherein the end element comprises a locating and locking device hereunder referred to as a yoke having an apertured upper part and lower part adapted respectively to receive the upper end of the vertical member of a similar scaffolding element and to engage either the horizontal or vertical member of that similar scaffolding element to limit relative movement between the two elements. The lower part is preferably adapted to lie under the horizontal member of the second element when the vertical member is received in the apertured upper part.

The lower part of the yoke is preferably adapted to engage the vertical member releasably. The lower part is preferably provided with a slot extending transversely to receive the vertical member below its join with the horizontal member. A collar is preferably provided near the upper end of the vertical member on which collar the upper part of the yoke of a similar scaffolding element can rest.

According to another aspect of the invention there is provided a construction comprising at least two courses of scaffolding elements each of which courses comprises at least three scaffolding elements as set out above the end element of each scaffolding element having the vertical member of an adjacent element in that course passing through the aperture in the upper part and being received in the end of the slot in the lower part of the element, there further being provided locating means entering into and connecting the adjacent upper and lower ends of aligned vertical members of two courses.

An embodiment of the invention will now be described by way of example with reference to the accompanying drawings.

Figure 1:
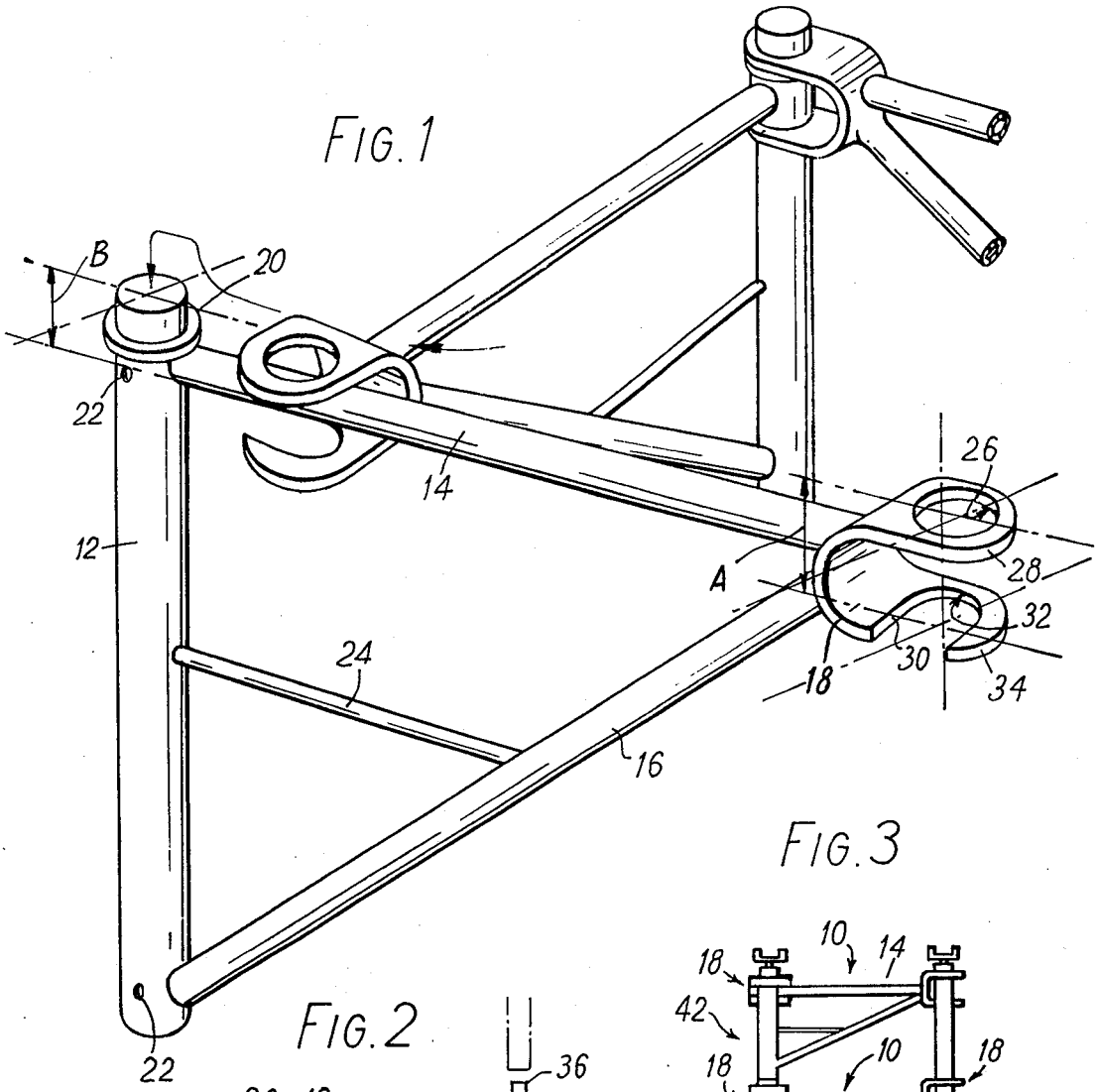
FIG. 1 is a perspective view of a part of a scaffolding tower formed from scaffolding elements of the invention.
Figure 2:
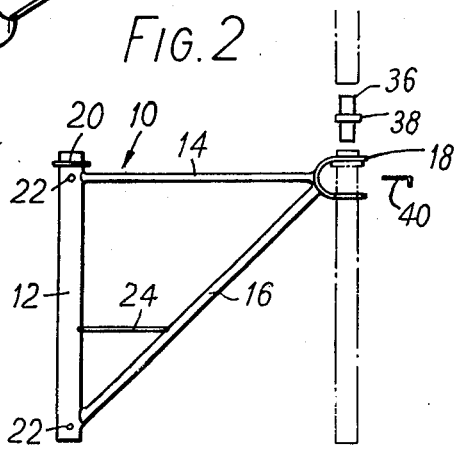
FIG. 2 is a side view of a scaffolding element of the invention with adjacent parts shown in exploded view in chain lines.

Referring now to the drawings, a scaffolding element 10 of the invention comprises a right angled triangular frame formed of tubular members 12, 14 and 16. The tubular member 12 is a robust load bearing vertical member. At locations adjacent the upper and lower ends of the member 12 are welded respectively the ends of the members 14 and 16 which extend respectively horizontally and in an upwardly inclined direction. The free ends of the members 14 and 16 are welded to the base of the U shaped yoke 18 which will be described below. A collar 20 is welded to the vertical member 12 above the horizontal member 14 but somewhat below the upper end of the member 12. Two pairs of diametrically extending registering locking pin holes 22 are provided near the upper and lower ends of member 12 respectively. A horizontal cross-member 24 of somewhat lighter construction than members 12, 14 and 16 extends from mid-way along the length of the vertical member to the inclined member.

The yoke 18 has its upper and lower arms lying horizontally. An aperture 26 is provided in the upper arm 28. A transverse slot 30 having a semi-circular base 32 extends from one side edge of the lower arm 34. The base 32 of slot 30 is aligned with the corresponding part of the aperture 26. When two scaffolding elements are connected, the upper end of the vertical member 12 of one element is received in the aperture 26 while the slot engages the member 12 below the vertical member. The spacing between the arm is such that when the upper arm 28 passes over the upper end of the vertical member 12, the lower arm 34 will be below and spaced from the horizontal member 14. The distance A between the upper and lower parts of the yoke is slightly greater than the distance B between the end of vertical member 12 and the underside of horizontal member 14.

The distance between the upper face of the collar 20 and the upper end of the vertical member 12 is about 25% greater than the thickness of the upper arm 28 of the yoke 18.

In addition to the scaffolding elements 10, a scaffolding tower will include tubular locating pins 36 which can fit loosely but reasonably snugly in the members 12. Each pin 36 has a central collar 38 which prevents the pin falling into the member 12 and four pairs of registering holes (not shown) to receive locking pins 40 as will be described. Further the tower will comprise base members and at its upper ends jacks which being conventional will not be described herein and are not illustrated.

Figure 3:
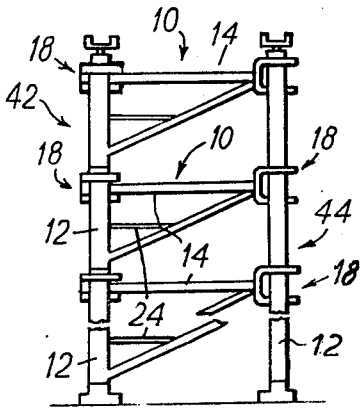
FIG. 3 is a side view of the stacked elements of this drawing.

A four-sided tower 42 (as shown in FIG. 3) will be errected as follows (ignoring for the purpose of this description the base members which are of course necessary in normal use): One element 10 is arranged in an upright position. A second element is located upright adjacent the first and is manipulated until its yoke 18 engages around the horizontal member 14. It is swung round until the yoke is close to the vertical member; then lifted and swung further until the vertical member is received in the slot 30 and the aperture 26 is above the vertical member. The second scaffolding element is then lowered so that the upper end of the vertical member is received in the aperture 26. Two other scaffolding elements are connected together in similar manner and the first element is connected to the fourth in much the same manner. Thus a course 44 is completed. It should be noted that there must be sufficient play between the aperture 26 and slot 30 to allow for some limited movement of vertical members to enable the first scaffolding element to be moved to enable its yoke to engage the vertical member of the fourth element.

The locating pins 36 are now dropped into the upper ends of the vertical members. If desired they can be inserted after each connection is made. The locking pins 40 are now passed through the apertures 22 and the apertures in the locating pins which register with apertures 22. The next course of scaffolding elements is set up in similar manner, with the lower ends of the vertical members fitting over the upper ends of the locating pins 36, and resting on the collars 38 of the locating pins 36. A diagonal cross-bracing member may extend between the vertical members every two or three courses to ensure the tower maintains its square configuration in plan. Further where there is a number of towers, link bars way connect the tower together for purposes well known in the art.

It will be noted that the provision of the lower arm 34 has the effect of limiting the movement of the yoke relative to the vertical member. Thus, a stable construction results and the possibility of the yoke inadvertently pulling off the upper end of a vertical member is minimized virtually to zero. This is because the only way that a scaffolding element 10 can be completely removed is by way of lifting it vertically and swinging it inwardly from its aligned position. A workman can, therefore, climb on to the upper course of the outside of the tower as well as on the inside without fear of the course collapsing. Such climbing is facilitated by the provision of the cross-member 24.

It will also be noted that the open upper and lower ends of the vertical member 12 constitute female nesting means for the lower and upper ends of the pins 36. We have found that erection and dismantling of a tower as above described can be effected easily and quickly.

The invention is not limited to the precise constructional details hereinbefore described and illustrated in the drawings. For example the cross members 24 may be ommitted. The tower can if desired take up any polygonal configuration in plan.

Finally it will be apparant that the terms "upper" and "lower", "vertical" and "horizontal" refer to the disposition of the parts when assembled in a vertical tower as described above.

I claim:

1. In a scaffolding element of the kind comprising a right angled triangular frame consisting of a vertical member, a horizontal member extending from near the upper end of the vertical member, an inclined member extending upwardly from near the lower end of the vertical member, an end element at the ends of horizontal and inclined members the improvement that the end element comprises a locating and locking yoke having an upper part and a lower part both fixed as to vertical movement relative to the horizontal member the upper part having an aperture of a diameter slightly greater than the diameter of the vertical member and the space between the upper and lower parts slightly greater than the distance between the end of the vertical member and the underside of the horizontal.

2. A scaffolding element as claimed in claim 1 in which the lower part is provided with a slot extending transversely to the direction of the vertical member and being slightly wider than the diameter of the vertical member.

3. A scaffolding element as claimed in claim 1 further comprising a collar on the vertical member near its upper end and above the horizontal member.

4. A scaffolding element as claimed in claim 1, wherein the lower part of said locating and locking yoke includes hook means for holding the vertical member of an adjacent second scaffolding element in hooked relationship thereto.

5. A construction comprising at least two courses of scaffolding elements each of which courses comprises at least three scaffolding elements as claimed in claim 2 the end of each scaffolding element having the vertical member of an adjacent element in that course passing through the aperture in the upper part and being received in the end of the slot in the lower part of the element, there further being provided locating pin means entering into and connecting the adjacent upper and lower ends of aligned vertical members of two courses.

6. A construction as claimed in claim 5 in which the locating pin means are separate from the scaffolding elements.

7. A construction as claimed in claim 6 further comprising locking pin means engaging the vertical members and the locating pin means to locate the latter to the frame.

8. A scaffold comprising a plurality of interlocked scaffolding elements, said scaffolding elements comprising a right-angled triangular frame consisting of a vertical member, a horizontal member extending from near the upper end of the vertical member, an inclined member extending upwardly from near the lower end of the vertical member to the end of the horizontal member furthest from said vertical member, and a locating and locking yoke at the end of said horizontal and inclined members, said yoke having an upper part and a lower part both fixed as to vertical movement relative to the horizontal member, the upper part having an aperture of a diameter slightly greater than the diameter of said vertical member, the lower member including means to hookedly engage the vertical member of an adjacent scaffolding element, the space between the upper and lower parts being slightly greater than the distance between the end of said vertical member and the underside of the horizontal member.

9. The scaffold of claim 8, wherein said lower part includes a slot extending generally transversely to the direction of the vertical member, and being slightly wider than the diameter of the vertical member, for hookedly engaging said vertical member.

* * * * *